US006921508B2

(12) United States Patent
Latini et al.

(10) Patent No.: US 6,921,508 B2
(45) Date of Patent: Jul. 26, 2005

(54) METHOD FOR THE PRODUCTION OF MICROFIBROUS SUEDE-FINISH NON-WOVEN FABRIC WITHOUT USING ORGANIC SOLVENTS

(75) Inventors: David Latini, Terni (IT); Gianni Romani, Configni (IT)

(73) Assignee: Alcantara S.p.A., Milan (IT)

( * ) Notice: Subject to any disclaimer, the term of this patent is extended or adjusted under 35 U.S.C. 154(b) by 275 days.

(21) Appl. No.: 10/096,324

(22) Filed: Mar. 12, 2002

(65) Prior Publication Data

US 2003/0017773 A1 Jan. 23, 2003

(30) Foreign Application Priority Data

Mar. 12, 2001 (IT) ..... MI2001A0516

(51) Int. Cl.[7] ..... D06N 3/00; D06N 3/14; D01F 8/04

(52) U.S. Cl. ..... 264/172.13; 427/243; 442/102

(58) Field of Search ..... 427/243; 264/172.13; 442/59, 102, 164, 168

(56) References Cited

U.S. PATENT DOCUMENTS

| | | | | |
|---|---|---|---|---|
| 3,531,368 A | | 9/1970 | Okamoto et al. | |
| 3,731,352 A | | 5/1973 | Okamoto et al. | |
| 3,899,623 A | | 8/1975 | Okazaki et al. | |
| 4,206,257 A | | 6/1980 | Fukushima et al. | |
| 4,420,522 A | * | 12/1983 | Masuda et al. | 428/95 |
| 4,613,527 A | * | 9/1986 | Potter et al. | 427/412 |
| 6,284,680 B1 | * | 9/2001 | Aikawa et al. | 442/363 |
| 6,322,851 B1 | * | 11/2001 | Adachi et al. | 427/246 |
| 6,517,938 B1 | * | 2/2003 | Andoh et al. | 428/395 |
| 2001/0024709 A1 | * | 9/2001 | Yoneda et al. | 428/91 |
| 2002/0009938 A1 | * | 1/2002 | Katayama et al. | 442/181 |
| 2002/0081418 A1 | * | 6/2002 | Iijima et al. | 428/151 |

FOREIGN PATENT DOCUMENTS

| | | | |
|---|---|---|---|
| EP | 1 041 191 | | 10/2000 |
| IT | 823055 | | 9/1968 |
| IT | 839921 | | 3/1969 |
| IT | 858373 | | 2/1970 |
| IT | 873699 | | 10/1970 |
| IT | 905222 | | 2/1972 |
| IT | 921871 | | 6/1972 |
| JP | 49-116366 | * | 11/1974 |
| JP | 61215782 A | | 9/1986 |
| JP | 5-33256 | * | 2/1993 |

* cited by examiner

*Primary Examiner*—Melvin Mayes
(74) *Attorney, Agent, or Firm*—Pauley Petersen & Erickson

(57) ABSTRACT

A method of preparation of microfibrous non-woven fabric of the suede-finish type comprising the steps of: spinning of a bi-component fiber of the "islands in the sea" type in which the "island" comprises a polymer chosen from among those employed in textile applications while the "sea" is a polymer that can dissolve and be removed by means of treatment with water, alkaline or acidic aqueous solutions, with non-polluting organic solvents alone or in aqueous solution; preparing a felt with the bi-component fiber; impregnating the felt with aqueous solution of polyvinylalcohol with reduced solubility in water; removing the "sea" component by treatment with solvents step; impregnating with emulsion or polyurethane dispersion; removing the polyvinylalcohol; and finishing the non-woven fabric obtained.

22 Claims, 2 Drawing Sheets

METHOD FOR THE PRODUCTION OF MICROFIBROUS SUEDE-FINISH NON-WOVEN FABRIC WITHOUT USING ORGANIC SOLVENTS

FIELD OF THE INVENTION

This invention relates to a method for the production of synthetic microfibrous non-woven fabric of the so-called suede-finish type that does not require the use of organic solvents, but that allows a product with optimal physical-mechanical and tactile characteristics to be obtained.

DESCRIPTION OF RELATED ART

A traditional process for the production of microfibrous suede-finish non-woven fabric which is typically described in Italian Patents Nos. 823055; 839921; 858373; 873699; 905222; and 921871 and in U.S. Pat. Nos. 3,531,368 and 3,899,623 is known and is currently being exploited commercially.

According to the related art, a fiber of the "islands in the sea" type is prepared from two components by feeding two polymers to a die-plate in such a way that one of the components—"sea"—completely surrounds several filaments of the other constituent—"islands". In the two-component fiber the "sea" component is generally polystyrene (PST) or another polymer that has such spinning characteristics as to wrap itself around the microfibers of the "islands" component and is moreover easily soluble in normal organic solvents. Typically, the sea component is polyethyleneterphthalate (PET). A felt is prepared with the fiber thus obtained, by means of drawing; it is impregnated with an aqueous polyvinylalcohol solution (PVA), the sea component is dissolved in trichloroethylene ("trielene"), the felt is impregnated with a polyurethane solution (PU) in dimethylformamide (DMF) and, finally, the PVA is eliminated. The product thus obtained is cut in two in section, buffed, dyed in suitable jets of dye, and finished. The attached FIG. 1 shows a simplified block outline of the process described above.

The method described above requires the use of two organic solvents (trielene and dimethylformamide) which can be recovered to be recycled in the production process and/or run off as waste, which involves a great deal of labor and high industrial costs, including those for safeguarding the environment.

In order to eliminate or reduce the quantity of the aforementioned solvents, other production methods have been proposed for microfibrous suede-finish non-woven fabric where the sea component is another polymer, such as polyethylene, which can be extracted with toluene; nylon 6, which is soluble in formic or sulfuric acid; and/or certain modified polyesters, which are soluble in acid or alkaline solutions, etc. Similarly, polyurethanes dispersed in an aqueous emulsion have been described as replacements for solutions of polyurethane in dimethylformamide or in other organic solvents of the process. However, while such alternative methods seem to have resolved the problem of the use of organic solvents, such alternative methods create drawbacks with respect to physical and chemico-physical characteristics of the product. In fact, the process that involves direct impregnation of the felt with a bi-component fiber, PU in aqueous emulsion, and the successive dissolving of the "sea" component, would eliminate the use of dimethylformamide and the PVA impregnation phase and its removal, leading to a finished product with less than optimal tactile and physical-mechanical characteristics—above all in terms of abrasion resistance, since the PU-microfiber bond has been found to be weakened after the extraction of the "sea" component. In the processes in which the felt is impregnated beforehand with a PVA solution, followed by dissolving the "sea" component with an organic solvent and successive impregnation with a solution of PU in organic solvent (generally DMF or DMAc), the bond between PU and microfiber is stronger and, consequently, all the physical-mechanical characteristics—and the abrasion resistance above all are better.

SUMMARY OF THE INVENTION

The present invention proposes to overcome all the aforementioned disadvantages. In more detail, the present invention relates to a method for the production of microfibrous non-woven fabric of the suede-finish type that does not use organic solvents which introduce a high cost of recovery and disposal, enabling the production of products with chemical-physical characteristics substantially equal if not superior to those of the products of the known art.

The objectives of the present invention are achieved by a method for the preparation of microfibrous non-woven fabric of the suede-finish type that comprises the following steps:

a) spinning of a bi-component fiber of the "islands in the sea" type, in which the "island" comprises a polymer chosen from those employed in textile applications, while the "sea" is a polymer that is dissolved and removed by means of treatment with water, alkaline or acidic aqueous solutions, with non-polluting organic solvents alone or in aqueous solution;

b) preparation of a felt with the bi-component fiber, c) impregnation of the felt with aqueous solution of polyvinylalcohol with reduced solubility in water;

d) removal of the "sea" component by means of treatments with solvents defined in step a);

e) impregnation with emulsion or aqueous polyurethane dispersion;

f) removal of the polyvinylalcohol;

g) finishing treatments of the non-woven fabric thus obtained.

According to the present invention, the "islands" component could be constituted by polyethyleneterphthalate or modified polyesters, cationic polyesters, nylon or other types of polyamides, from polyethylene, polypropylene or other types of poliolefine.

BRIEF DESCRIPTION OF DRAWINGS

These and other objects and features of this invention will be better understood from the following detailed description taken in conjunction with the drawings, wherein.

DETAILED DESCRIPTION OF PREFERRED EMBODIMENTS

Figure 1:
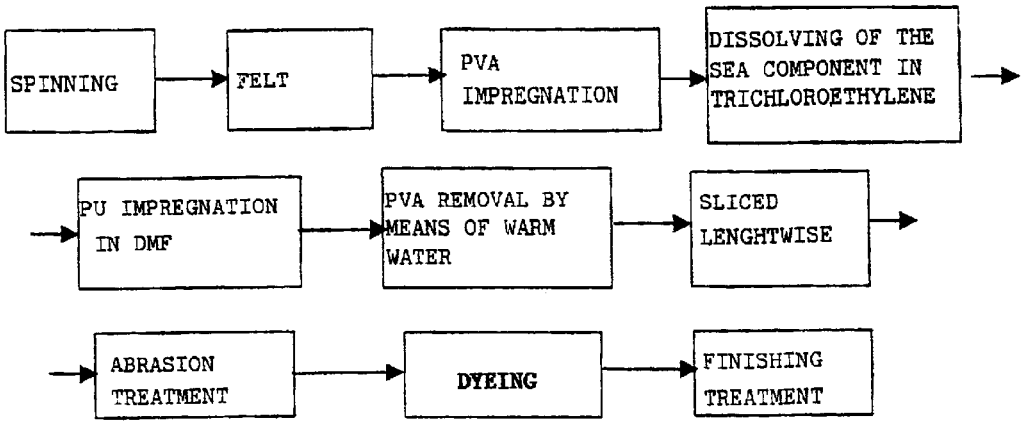
FIG. 1 is a simplified block diagram showing a method for the production of microfibrous suede-finish non-woven fabric according to the prior art.
Figure 2:
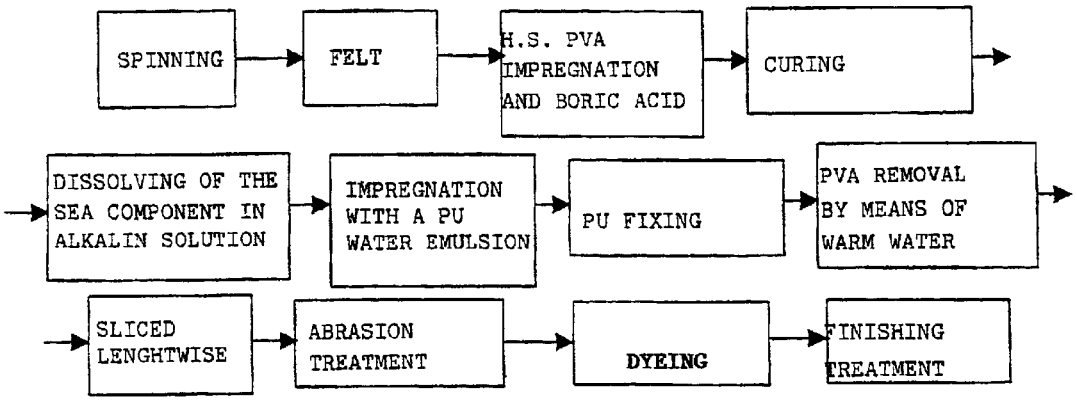
FIG. 2 is a simplified block diagram showing a method for the production of microfibrous suede-finish non-woven fabric according to one preferred embodiment of this invention.

FIG. 2 shows a simplified block outline of the method according to the invention for the production of non-woven fabric. The "sea" components may comprise nylon or other polyamides, modified polyesters and, in a generalized manner, other polymer fibers with the essential characteristic of being soluble in "ecologically clean" solvents, preferably in acidic or alkaline aqueous solutions. The ratio between the "island" component and the "sea" component used in the spinning bi-component must be within the range 20/80 and 80/20.

The polyvinylalcohol employed in the process of the present invention in order to impregnate the bi-component fiber felt, should have solubility in water or the aqueous solvents used for its removal, significantly lower than the solubility of the "sea" component of the bi-component fiber. Such lower solubility can be intrinsic of the polymer or can be created after impregnation by means of hot treatments successive to the impregnation or by adding compounds that can cause a reticulation of the polyvinylalcohol.

As reduced solubility polyvinylalcohol, a polyvinylalcohol must be used with high saponification index, typically superior to 95% and, preferably, superior to 99.5%. This polyvinylalcohol has a high degree of crystalinity and a much lower viscosity (at 25° C., a 12% solution must have a viscosity in the range 100 to 300 mPas and at 20° C., a 4% solution must have a viscosity in the range 10 to 16 mPAs).

The lower solubility of the polyvinylalcohol can also be obtained by means of treatment of the polyvinylalcohol after impregnation, as stated above. One way to render the polyvinylalcohol more difficult to remove in the course of removing the "sea" component, is by treating the impregnated felt at high temperature, in the range 150° to 200° C., for a period of time between 5 and 40 minutes. Another way of rendering the polyvinylalcohol more resistant to the sea component removal treatment is to add a cross-linking "cross-linker" (chosen from boric acid $H_3BO_3$, or zirconium or vanadium compounds such as triethanolamine zirconate or vanadate-boric acid being preferred) to the of PVA impregnation solution in amounts ranging from 0.5% to 7% with respect to PVA, and preferably between 1% and 5%. Both methods described above can also be used to reduce the solubility of the Polyvinylalcohol and prevent its removal in the course of the "sea" component removal treatment. The addition of cross-linking agents-boric acid in particular—reduces the solubility of the polyvinylalcohol in an alkaline environment, while the extraction in an acid environment is not substantially modified.

The impregnation of the felt with polyurethane after the elimination of the "sea" component can be achieved by addition of dimethylformamide or dimethylacetamide PU solution, analogous to what happens in the conventional systems indicated above, or, preferably, with polyurethane impregnation in emulsion or aqueous dispersion. If the method with polyurethane in emulsion or aqueous dispersion is used, it is necessary that the bond between the polyurethane and felt and the polyurethane itself can resist the extraction of the polyvinylalcohol. For this purpose, analogous to what happens for polyvinylalcohol in the extraction of the "sea" component, it is necessary to fix the polyurethane so that it can resist the treatment of the felt in order to extract the polyvinylalcohol.

The impregnation of the polyurethane can take place by means of the addition of cross-linking agents known in the art which, according to the type, are active at ambient temperatures or relatively high temperatures (110°–200° C.).

The impregnated felt is therefore treated with warm water preferably in a vibro-washer at temperatures in the range 50° to 110° C., and preferably between 85° and 95° C. In the case of adding boric acid or other reticulators, the pH of the solution will have to be in the range 3 to 7.

The operations that are executed in order to realize the method of the present invention will be described below in greater detail, while the examples will allow the advantages of the same method to be appreciated.

A bi-component fiber is spun through a die-plate very well known to one skilled in the art, and enables a compound fiber to be obtained in which one of the polymers is arranged around the elementary fibers of the other polymer. The fiber thus obtained is treated according to finishing methods known in the art of spinning; in particular, the bi-component fiber, before spinning, must have a denier rating in the range 10 to 13 denier, preferably in the range 11 to 12.5 denier. Drawing is executed with draw-ratios that generally vary in the range 2 to 5, and preferably in the interval 3 to 4, with a final denier rating of the bi-component compound fiber between 2 to 6 denier and the denier rating of the component "islands" within the range 0.08-0.5 denier.

In the present invention, it is preferable to use a bi-component fiber consisting of polyethyleneterphthalate as "island" component, and a modified polyester soluble in an alkaline aqueous solution, as "sea" component. Said "sea" component consists of PET-5-sodiosolfo-isoptalic acid ethylenglicol ester, hereinafter referred to as TLAS.

A felt is prepared with such bi-component fiber by drawing; the apparent density of the felt, (after dimensional stabilization by heat treatment with warm water or warm air, or directly in hot PVA impregnation solution) must be, preferentially, in the range 0.1 to 0.5 g/cm$^3$, more preferably in the range, 0.15–0.4 g/cm$^3$, with thickness still in the range 2 to 4 millimeter, in order to obtain a final non-woven fabric with good softness.

The felt thus obtained is impregnated with an aqueous polyvinylalcohol solution (PVA), with a concentration in the range 5% to 30% preferably in the range 8% to 15%, more preferably between 10% and 13%, and at a temperature in the range 60° to 90° C. In such a way a mean PVA concentration is obtained in the range 10 to 40%, preferably in the range 15 to 25%. Unlike traditional processes that use the PVA for the production of non-woven fabric, the PVA used in the present invention must have a higher degree of crystalinity, a saponification value in the range 85% and 100%, preferably superior to 99.5%, and a very low viscosity (at 25° C., a 12% solution must have a viscosity in the range 100 to 300 mPA·s and at 20° C., a 4% solution must have a viscosity in the range 10 to 16 mPA·s). The high saponification rate polyvinylalcohol is referred to below simply as H.S.PVA.

Figure 3:
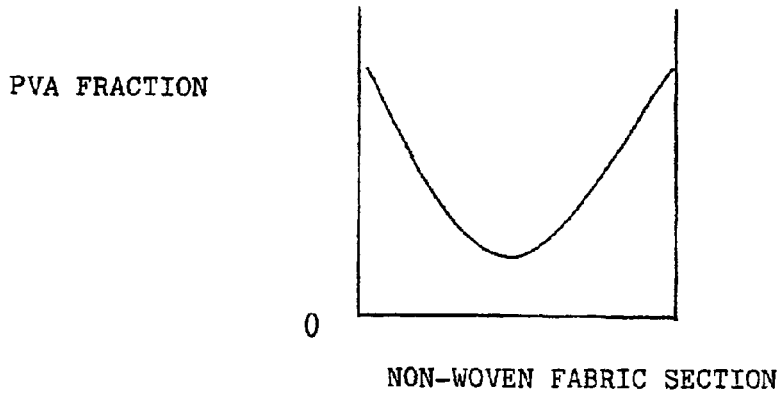
FIG. 3 is a graph showing the distribution of H.S.PVA across a thickness of the non-woven fabric according to one preferred embodiment of this invention.

The H.S.PVA applied to the felt in this stage, must subsequently resist the drastic conditions of dissolving the "sea" component, for which it needs to be subjected, as well as normal drying, to a thermo-fixing or curing treatment at high temperature, in the range 150° to 200° C., for a time in the range 5 to 40 minutes. To obtain an end-product with softness and appearance characteristics similar to that obtained with traditional methods that use organic solvents, the H.S.PVA in the section of the non-woven fabric is present for the greater part in the surface and, to a lesser extent, the central zone. FIG. 3 shows the distribution of the H.S.PVA across the thickness of the non-woven fabric according to the invention after dissolving the "sea" component.

To optimize such distribution of the H.S.PVA and to increase its ability to resist the dissolving of the "sea"

component in basic environments, an amount of boric acid $H_3BO_3$ varying in the range 0.5% to 10% and preferably between 1% and 5% with respect to the PVA is used as cross-linker of the H.S.PVA, and is added to the H.S.PVA impregnation solution. As an alternative way a definite amount of $H_3BO_3$ may be added to the alkaline bath used for the removal of sea component after PVA impregnation and fixing phase.

In order to extract the "sea" component of the bi-component fiber, a treatment is carried out with an aqueous sodium hydroxide solution, with a concentration in the range 1% to 15% and at a temperature of between 40° and 90° C.; the time to dissolve the "sea "component varying according to the conditions, from 4 to 40 minutes. In general, the dissolving conditions are optimized in order to dissolve the "sea" component in the shortest possible time and, in such time, to dissolve the smallest possible amount of applied H.S.PVA while avoiding any significative PET microfiber deterioration.

The piece is subsequently washed abundantly with water at room temperature, to remove the soda residue remaining impregnated in the non-woven, thus preventing partial dissolving of the "islands" component.

The non-woven fabric from which the "sea" component has been extracted is impregnated with polyurethane dispersed in aqueous emulsion, at room temperature, with a concentration varying between 10% and 20%, and it is dosed on the piece through suitable spreader rollers to obtain, in the final product, a PU concentration of 25 to 45%, preferably 30 to 40%.

A portion of PU may be added to the piece before submitting it to the alkaline treatment to remove the sea component in order to improve the piece resistance against the above alkaline treatment as well as the physical and mechanical characteristics of the final product.

The polyols that constitute polyurethane (PU) can be of polyether type, polyester type, polycarbonate type and polyester-polycarbonate type; the PU can be prepared using one or more of such types of polyols that must have an average molecular weight in the range 500 to 5000.

The di-isocyanates used for the synthesis of the PU could be aliphatic or aromatic; chain extenders generally used, instead, are low molecular weight molecules that possess two or more active hydrogens that can react with the isocyanate groups. The PU is generally synthesized by preparing the prepolymer with terminal isocyanic groups creating an aqueous emulsion through violent agitation and extending it with a suitable extender until the desired molecular weight is attained.

In order to carry the prepolymer into emulsion, external emulsioning agents may be used or prepolymers are prepared containing a fraction of polyols with hydrophilic character and/or loaded with such groups, to obtain a polyurethane self-emulsifier prepolymer.

In a method for the manufacture of suede-like microfibrous non-woven materials, without using any organic solvents, the preferred water emulsioned PU are those of aliphatic type, anionic obtained by contacting polyols and ionomers according to the correct ratios, enabling resistance to any severe treatment, i.e., acid ambient dying and basic reduction thereof, hot water and alkaline washing cycles.

External emulsifier can be ionic or non ionic surfactants, and are generally added in an amount ranging from 0.5% to 10% with respect to the PU. However, self emulsifier PU are preferred which are obtained by means of groups which are progressively negatively charged, as dimetilolpropionic acid (DMIPA) or functionalized sulfonic acids, forming a negatively charged emulsioned PU aqueous solution; said groups are added in a range 0.5 to 10% with respect to poliol concentration and are neutralized with triethylamine.

An amount of cross-linking agent varying from 0.5% to 8% can be added to the aqueous polyurethane solution used for impregnation, with the aim of reaching the desired physical-mechanical characteristics and solvent resistance; such reticulating, which can be melamines, aziridine, carbodiimide, epoxides, zirconium compounds, or isocyan bases are active in drying phase of the PU at a temperature that varies from 110° C. to 180° C.

The polyurethane resin impregnated in the non-woven fabric, is thermo-fixed to the same by drying, or is preliminarily coagulated and then dried; as an example, in the case of anionic type PU, coagulation can be carried out in an acidic aqueous solution, or, for a cationic PU, in an alkaline aqueous solution. In any case, the phase of implantation of the PU in the microfiber must happen in the shortest possible time, to avoid migration of the PU to the surface of the non-woven fabric, with consequent worsening of the chemical-physical characteristics and the aspect. When the impregnation is achieved through drying, the use of warm air furnaces with very high temperatures, in the range 150° to 200° C., or of steamers that combine the effect of microwaves to the vapor action, is advisable.

Once the PU is fixed, the H.S.PVA must be removed from the non-woven fabric, and this is done in a vibro-washer with warm water, at a temperature in the range 85° to 95° C.; in case boric acid is added to H.S.PVA, the pH of the aqueous washing solution must be lowered to 3 to 5, while maintaining the temperature equally high.

The final piece is preferably dried in a warm air furnace and subjected to successive phases of working, which are, respectively, cutting in two along the section, emery polishing, dying and finishing.

The operating conditions of these productive stages reflect those used in the production of non-woven fabrics which use organic solvents.

EXAMPLE 1

Preparation of Non-Woven Fabric Until the Dissolving of the "Sea" Component

A fiber is prepared in flocking formed from microfibers of PET (polyethyleneterphthalate) (0.13 to 0.15 denier) in a modified polyester matrix (TLAS), having the following characteristic:

1—denier rating 3.9

2—length 51 millimeters

3—curl approximately 4/cm

4—draw ratio 3.5/1

In detail, the fiber is formed from 57 parts by weight of PET and 43 parts by weight of TLAS. If observed in section the fiber reveals the presence of 16 microfibers of PET embedded in the TLAS matrix. With the fiber in flocking, a crude felt is prepared that is subjected to drawing in order to form a drawn felt with density 0.217 g/cc. The drawn felt is re-emerged in warm water at a temperature of 90° C. giving a density of 0.331 g/cc; this is then dipped in a 12% high saponification value polyvinylalcohol solution (H.S.PVA) at a temperature around 70° C. and is thermo-fixed in a furnace at 150° C. for 30 minutes. The piece impregnated with PVA is dipped in a 10% solution of NaOH at a temperature of 60° C.; the "sea" component dissolves in 18 minutes and in such conditions 8% of H.S.PVA is dissolved (see Table 1).

EXAMPLE 2

Preparation of No-Woven Fabric Until the Dissolving of the "Sea" Component

Take a sample of felt impregnated and thermo-fixed with H.S.PVA as prepared in Example 1 and dissolve the "sea" component of the fiber by immersing it in a 5% solution of NaOH at a temperature of 60° C.; the "sea" component dissolves in 20 minutes and in such conditions 15% of H.S.PVA is dissolved (see Table 1).

EXAMPLE 3

Preparation of Non-Woven Fabric Until the Dissolving of the "Sea" Component

Take a sample of felt impregnated with H.S.PVA as prepared in Example 1 and thermo-fix it at a temperature of 130° C. The "sea" component of the fiber is dissolved by immersing it in a 5% solution of NaOH at a temperature of 60° C.; the "sea" component dissolves in 12 minutes and in such time 29% of H.S.PVA is dissolved (see Table 1).

EXAMPLE 4

Preparation of Non-Woven Fabric Until the Dissolving of the "Sea" Component

Take a sample of felt impregnated and thermo-fixed with H.S.PVA as prepared in example 3 and the sea component of the fiber is dissolved by immersing it in a 10% solution of NaOH at a temperature of 60° C.; the "sea" component dissolves in 11 minutes and in such time 18% of H.S.PVA is dissolved (see Table 1).

EXAMPLE 5

Preparation of Non-Woven Fabric Until the Dissolving of the "Sea" Component

Take a sample of felt impregnated with H.S.PVA as prepared in Example 1 and thermo-fixed at a temperature of 140° C. The "sea" component of the fiber is dissolved by immersing it in a 7.5% solution of NaOH at a temperature of 64° C.; in such conditions the "sea" component dissolves in 10 minutes and in such time 17% of H.S.PVA is dissolved (see Table 1).

EXAMPLE 6

Preparation of Non-Woven Fabric Until the Dissolving of the "Sea" Component

Take a sample of felt impregnated with H.S.PVA and thermo-fixed as prepared in example 5 and dissolve the "sea" component of the fiber by immersing it in a 11% solution of NaOH at a temperature of 50°C.; in such conditions the "sea" component dissolves in 27 minutes and in such time 5% of H.S.PVA is dissolved (see Table 1).

EXAMPLE 7

Preparation of Non-Woven Fabric Until the Dissolving of the "Sea" Component

Take a sample of felt impregnated with H.S.PVA and thermo-fixed as prepared in example 5 and dissolve "sea" component of the fiber by immersing it in a 7.5% solution of NaOH at a temperature of 50° C.; in such conditions the "sea" component dissolves in 30 minutes and in such time 11% of H.S.PVA is dissolved (see Table 1).

EXAMPLE 8

Preparation of Non-Woven Fabric Until the Dissolving of the "Sea" Component

Take a sample of felt impregnated with H.S.PVA as prepared in Example 1 and thermo-fixed at a temperature of 126° C. The "sea" component of the fiber is dissolved by immersing it in a 7.5% solution of NaOH at a temperature of 50° C.; in such conditions the "sea" component dissolves in 20 minutes and in such time 16% of H.S.PVA is dissolved (see Table 1).

COMPARATIVE EXAMPLES 9, 10, 11, 12, 13, 14, 15

Preparation of Non-Woven Fabric Until the Dissolving of the "Sea" Component

Take the felt re-immersed in warm water, impregnated with H.S.PVA, prepared as in example 1, thermo-fixed at a determined temperature and dissolve it in a solution of NaOH of determined % and at a fixed temperature, according to the specific example. However, all these tests required an excessive time to dissolve the "sea" component (see Table 1); the object of the solution, in fact, is to complete the elimination of the external polymer from the bicomponent fiber in a maximum time of 10 minutes, reducing the percentage of the H.S.PVA dissolved to a value lower than 10%.

TABLE 1

| Example | Dissolving Temperature (° C.) | Curing Temperature (° C.) | NaOH Concentration (%) | "Sea" component dissolving Time (min) | PVA dissolved (5) |
|---|---|---|---|---|---|
| 9 | 40 | 130 | 5 | >30 | — |
| 3 | 60 | 130 | 5 | 12 | 29 |
| 10 | 40 | 150 | 5 | >30 | — |
| 2 | 60 | 150 | 5 | 20 | 15 |
| 11 | 40 | 130 | 10 | >30 | — |
| 4 | 60 | 130 | 10 | 11 | 18 |
| 12 | 40 | 150 | 10 | >30 | — |
| 1 | 60 | 150 | 10 | 18 | 8 |
| 5 | 64 | 140 | 7.5 | 10 | 17 |
| 13 | 36 | 140 | 7.5 | >30 | — |
| 14 | 50 | 154 | 7.5 | >30 | — |
| 8 | 50 | 126 | 7.5 | 20 | 16 |
| 6 | 50 | 140 | 11 | 27 | 5 |
| 15 | 50 | 140 | 4 | >30 | — |
| 7 | 50 | 140 | 7.5 | 30 | 11 |

The experiments are programmed according to the logic of a Statistical Design Experiment and in particular of a Composed Central Design. This series of experiments shows that a temperature increase increases the speed of dissolving TLAS as well as the speed of dissolving PVA; a temperature increase in the thermo-fixing (Curing) reduces the speed of dissolving the TLAS as well as that of H.S.PVA; an increase in the % NaOH increases the speed of dissolving TLAS but reduces that of H.S.PVA. It can be concluded that thermo-fixing at temperatures of 126° C., 130° C. and 140° C., does not produce efficient Curing; therefore Curing must be carried out at high temperatures, higher than 150° C.

EXAMPLE 16

Preparation of Non-Woven Fabric Until the Dissolving of the "Sea" Component

Take a sample of felt re-immersed in warm water as prepared in example 1 and impregnate it with 12% solution of H.S.PVA at approximately 70° C. containing a determined percentage of boric acid ($H_3B0_3$/PVA=0.01), and thermo-fix it, subsequently, at a temperature of 150° C. for 20 minutes. The "sea" component of the bi-component fiber of the prepared piece is then extracted by immersing it in a 10% solution of NaOH at a temperature of 70° C.; the sea component dissolves in 10 minutes and in such conditions 9% of H.S.PVA is dissolved (see Table 2).

EXAMPLE 17

Preparation of Non-Woven Fabric until the Dissolving of the "Sea" Component

Take a sample of felt re-immersed in warm water, impregnated with H.S.PVA/$H_3B0_3$ and thermo-fixed, prepared as in example 16 and extract the "sea" component by immersing it in a 10% solution of NaOH at a temperature of 60° C.; the "sea" component dissolves in 22 minutes and in such conditions 6% of H.S.PVA is dissolved (see Table 2).

EXAMPLE 18

Preparation of Non-Woven Fabric Until the Dissolving of the "Sea" Component

Take a sample of felt re-immersed in warm water, impregnated with H.S.PVA/$H_3B0_3$ and thermo-fixed, prepared as in example 16 and extract the "sea" component by immersing it in a 5% solution of NaOH at a temperature of 70° C.; the "sea" component dissolves in 18 minutes and in such conditions 31% of H.S.PVA is dissolved (see Table 2).

EXAMPLE 19

Preparation of Non-Woven Fabric Until the Dissolving of the "Sea" Component

Take a sample of felt re-immersed in warm water, impregnated with H.S.PVA/$H_3B0_3$ and thermo-fixed, prepared as in example 16 and extract the sea" component by immersing it in a 5% solution of NaOH at a temperature of 60° C.; the "sea" component dissolves in 30 minutes and in such conditions 15% of H.S.PVA is dissolved (see Table 2).

EXAMPLE 20

Preparation of Non-Woven Fabric Until the Dissolving of the Sea" Component

Take a sample of felt re-immersed in warm water prepared as in example 1 and impregnate it with a 12% solution of H.S.PVA at approximately 70° C. containing a determined percentage of boric acid ($H_3B0_3$/PVA=0.05), and thermo-fix it, subsequently, at a temperature of 150° C. for 20 minutes. The "sea" component of the bi-component fiber of the prepared piece is extracted by immersing it in a 10% solution of NaOH at a temperature of 60° C.; the "sea" component dissolves in 20 minutes and in such conditions 8% of H.S.PVA is dissolved (see Table 2).

EXAMPLE 21

Preparation of Non-Woven Fabric Until the Dissolving of the "Sea" Component

Take a sample of felt impregnated with H.S.PVA as prepared in Example 1 and thermo-fixed at a temperature of 180° C. The "sea" component of the fiber is dissolved by immersing it in a 10% solution of NaOH at a temperature of 70° C.; in such conditions the "sea" component dissolves in 8 minutes and in such time 6% of H.S.PVA dissolves (see Table 2).

EXAMPLE 22

Preparation of Non-Woven Fabric Until the Dissolving of the "Sea" Component

Take a sample of felt impregnated with H.S.PVA as prepared in Example 1 and thermo-fixed at a temperature of 150° C. The "sea" component of the fiber is dissolved by immersing it in a 10% solution of NaOH at a temperature of 70° C.; in such conditions the "sea" component dissolves in 7 minutes and in such time 10% of H.S.PVA is dissolved (see Table 2).

EXAMPLE 23

Preparation of Non-Woven Fabric Until the Dissolving of the "Sea" Component

Take a sample of felt impregnated with H.S.PVA as prepared in Example 1 and thermo-fixed at a temperature of 180° C. The "sea" component of the fiber is dissolved by immersing it in a 10% solution of NaOH at a temperature of 60° C.; in such conditions the "sea" component dissolves in 20 minutes and in such time 6% of H.S.PVA dissolves (see Table 2).

EXAMPLE 24

Preparation of Non-Woven Fabric Until the Dissolving of the "Sea" Component

Take a sample of felt impregnated with H.S.PVA and boric acid as prepared in example 16 and thermo-fixed at a temperature of 180° C. The "sea" component of the fiber is dissolved by immersing it in a 10% solution of NaOH at a temperature of 70° C.; in such conditions the "sea" component dissolves in 12 minutes and in such time 4% of H.S.PVA is dissolved (see Table 2).

EXAMPLE 25

Preparation of Non-Woven Fabric Until the Dissolving of the "Sea" Component

Take a sample of felt impregnated with H.S.PVA and boric acid as prepared in example 20 and thermo-fixed at a temperature of 150° C. The "sea" component of the fiber is dissolved by immersing it in a 10% solution of NaOH at a temperature of 70° C.; in such conditions the "sea" component dissolves in 9 minutes and in such time 16% of H.S.PVA is dissolved (see Table 2).

TABLE 2

| Example | Dissolving Temperature (° C.) | Temperature Curing (° C.) | NaOH Concentration (%) | % $H_3BO_3$/% PVA | "Sea" Component Solution | Dissolved PVA (%) |
|---|---|---|---|---|---|---|
| 16 | 70 | 150 | 10 | 0.01 | 12 | 10 |
| 17 | 60 | 150 | 10 | 0.01 | 22 | 6 |
| 18 | 70 | 150 | 5 | 0.01 | 18 | 31 |
| 19 | 60 | 150 | 5 | 0.01 | 30 | 16 |
| 20 | 60 | 150 | 10 | 0.05 | 20 | 15 |
| 21 | 70 | 180 | 10 | — | 6 | 1.6 |
| 22 | 70 | 150 | 10 | — | 7 | 10 |

TABLE 2-continued

| Example | Dissolving Temperature (° C.) | Temperature Curing (° C.) | NaOH Concentration (%) | % $H_3BO_3$/ % PVA | "Sea" Component Solution | Dissolved PVA (%) |
|---|---|---|---|---|---|---|
| 23 | 60 | 180 | 10 | — | 15 | 1.3 |
| 24 | 70 | 180 | 10 | 0.01 | 8 | 1.4 |
| 25 | 70 | 150 | 10 | 0.05 | 9 | 16 |

Figure 4:
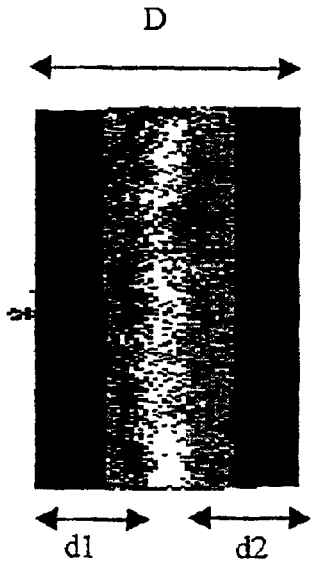
FIG. 4 is a magnified representation of a fiber according to a preferred embodiment of this invention.

FIG. 4 is a magnified representation of the fiber that shows the degree of migration (% migration of the PVA) of the distribution of the PVA along the thickness of the non-woven fabric after dissolving the "sea" component.

Such degree of migration is given by the formula:

$$\% \text{ Migration } PVA=((d1+d2)/2*D)*100$$

(Table 3) shows the distribution of the PVA after dissolving the "sea" component, estimated under optimum conditions; it is well that such value is the highest possible because the PVA must essentially be distributed on the surface but also appears in smaller mounts at the center of the piece.

TABLE 3

| Example | Dissolving Temperature (° C.) | Curing Temperature (° C.) | NaOH Concentration (%) | % $H_3BO_3$/ % PVA | PVA Migration % |
|---|---|---|---|---|---|
| 21 | 70 | 180 | 10 | — | 35 |
| 23 | 60 | 180 | 10 | — | 34 |
| 1 | 60 | 150 | 10 | — | 37 |
| 22 | 70 | 150 | 10 | — | 26 |
| 16 | 70 | 150 | 10 | .01 | 35 |
| 24 | 70 | 180 | 10 | 0.01 | 43 |
| 25 | 70 | 150 | 10 | 0.05 | 0 |
| Production With solvents | "Sea" component dissolved in trielene | | | | 43 |

It can be concluded that one of the best conditions for dissolving the "sea" component is that used in examples 16, 17, 24 and 25 in so much as it represents the best compromise between the time necessary to dissolve the TLAS, the amount of H.S.PVA dissolved in such time and the optimal distribution of the H.S.PVA.

EXAMPLE 26

Preparation of a Microfibrous Non-Woven Fabric

The piece obtained in Example 17 in which the "sea" component has been dissolved has been impregnated with a solution of PU in aqueous emulsion (Witcobond 279-34: anionic, aliphatic, polyester basis polyurethane) from Baxenden Chemicals, at a concentration of 13.5%. The piece is thermo-fixed for 30 minutes at a temperature of 160° C. Subsequently the H.S.PVA previously applied in warm water is dissolved at a temperature of 95° C. and pH=4. The piece is dried in an oven, cut in two in the section, buffed and dyed in a jet of dye. The piece has a good surface appearance. The chemical-physical characteristics and abrasion resistance are illustrated in Table 4.

EXAMPLE 27

Preparation of a Microfibrous Non-Woven Fabric

The piece obtained in Example 17 in which the "sea" component has been dissolved has been impregnated with a solution of PU in aqueous emulsion (Witcobond 279-34: anionic, aliphatic, polyether basis polyurethane) from Baxenden Chemicals, at a concentration of 12% in order to obtain 28% in the final product. The piece is thermo-fixed for 30 minutes at a temperature of 160° C. Subsequently the H.S.PVA previously applied in warm water is dissolved at a temperature of 95° C. and pH=4. The piece is dried in an oven, cut in two in the section, buffed and dyed in a jet of dye. The piece has a good surface appearance. The chemical-physical characteristics and abrasion resistance are illustrated in Table 4.

EXAMPLE 28

Preparation of a Microfibrous Non-Woven Fabric

The piece obtained in Example 17 in which the "sea" component has been dissolved, has been impregnated with a solution of PU in aqueous emulsion (Witcobond 279-34: anionic, aliphatic, polyether basis polyurethane) from Baxenden Chemicals, in aqueous emulsion at a concentration of 13.5%, to which has been added 5% of capped isocyanic cross-linking. The piece is thermo-fixed for 30 minutes at a temperature of 160° C. Subsequently the H.S.PVA previously applied in warm water, is dissolved at a temperature of 95° C. and pH=4. The piece is dried in an oven, cut in two in the section, buffed and dyed in a jet of dye. The piece has a good surface appearance. The chemical-physical characteristics and abrasion resistance are illustrated in table 4.

EXAMPLE 29

Preparation of a Microfibrous Non-Woven Fabric

The piece obtained in Example 17 in which the "sea" component has been dissolved, has been impregnated with a solution of PU in aqueous emulsion (Witcobond 279-34: anionic, aliphatic, polyether basis polyurethane) from Baxenden Chemicals, in aqueous emulsion at a concentration of 13.5%, to which has been added 5% of capped isocyaniccross-linking. The piece is thermo-fixed for 30 minutes at a temperature of 160° C. Subsequently the H.S.PVA previously applied in warm water, is dissolved at a temperature of 95° C. and pH=4. The piece is dried in an oven, cut in two in the section, buffed and dyed in a jet of dye. The piece has a good surface appearance. The chemical-physical characteristics and abrasion resistance are illustrated in table 4.

EXAMPLE 30

Preparation of a Microfibrous Non-Woven Fabric

The piece obtained in Example 17 in which the "sea" component has been dissolved, has been impregnated with a solution of PU in aqueous emulsion (Impranil DLV: anionic, alphatic, polyester basis polyurethane) from Bayer, in aqueous emulsion at a concentration of 13.5% in order to obtain 30% concentration in the final product, to which has been added 5% of capped isocyanic cross-linking agent. The piece is thermo-fixed for 30 minutes at a temperature of 160° C. Subsequently the H.S.PVA previously applied in warm water, is dissolved at a temperature of 95° C. and pH=4. The piece is dried in an oven, cut in two in the section, buffed and dyed in a jet of dye. The piece has a good surface appearance. The chemical-physical characteristics and abrasion resistance ate illustrated in table 4.

EXAMPLE 31

Preparation of a Microfibrous Non-Woven Fabric

The piece obtained in Example 17 in which the "sea" component has been dissolved, has been impregnated with a solution of PU in aqueous emulsion (Astacin Finish PF) anionic, aliphatic, polyether basis (polyurethane) from BASF, in aqueous emulsion at a concentration of 13.5%, to which has been added 5% of capped isocyianic agent The piece is thermo-fixed for 30 minutes at a temperature of 160° C. Subsequently the H.S.PVA previously applied in warm water, is dissolved at a temperature of 95° C. and pH=4. The piece is dried in an oven, cut in two in the section, buffed and dyed in a jet of dye. The piece has a good surface appearance. The chemical-physical characteristics and abrasion resistance are illustrated in table 4.

EXAMPLE 32

Preparation of a Microfibrous Non-Woven Fabric

A felt is prepared according to the procedure of Example 1 in which the PET/TLAS ratio is 57/43 and the apparent density is 0.331. The felt has been impregnated with a solution of PU (Witcobond aqueous emulsion containing 1% of boric acid from Baxenden Chemicals) at a concentration of 85%, to which has been added 5% of cupped isocyanic agent. The piece is thermo-fixed for 30 minutes at a temperature of 150° C. The piece contains 24% of PVA which is three fourth of total PU (32%). The H.S.PVA previously applied in warm water is then dissolved by treatment with a 10% sodium hydroxide water solution at a temperature of 60° C. The piece is impregnated again with the above PU solution to obtain the sought PU concentration (32%) in the final product. The piece is dried in an oven, cut in two in the section, buffed and dyed in a jet of dye. The piece has a good surface appearance. The chemical-physical characteristics and abrasion resistance are illustrated in table 4.

Similar results are obtained using analogous compounds suggested and disclosed in the previous reports.

TABLE 4

| Example | Tenacity L (N/cm) | Tenacity T (Kg/cm) | Stretch L (%) | Stretch T (%) | Appearance after abrasion | Weight lost in abrasion |
|---|---|---|---|---|---|---|
| 26 | 50 | 40 | 70 | 110 | Good | 2.5 |
| 27 | 45 | 35 | 72 | 115 | Good | 2.1 |
| 28 | 60 | 52 | 55 | 93 | Good | 4.5 |
| 29 | 57 | 48 | 58 | 95 | Good | 4.3 |
| 30 | 53 | 42 | 62 | 00 | Good | 4.0 |
| 31 | 63 | 58 | 53 | 84 | Good | 4.5 |
| 32 | 54 | 46 | 65 | 105 | Good | 2.2 |

What is claimed is:

1. A method for the preparation of microfibrous non-woven fabric of the suede-finish type comprising the following steps:

a) spinning of a bi-component fiber of the "islands in the sea" type in which the "island" comprises a polymer chosen from among those employed in textile applications while the "sea" is a polymer that can be dissolved and removed;

b) preparing a felt with the bi-component fiber;

c) impregnating the felt with aqueous solution of polyvinylalcohol with reduced or reducible solubility in water, wherein the solubility of the polyvinylalcohol is reduced by successive hot impregnation treatments;

d) removing the "sea" component by treatment with water, alkaline or acidic aqueous solutions, with non-polluting organic solvents either alone or in an aqueous solution;

e) impregnating with polyurethane emulsion or dispersion;

f) removing the polyvinylalcohol; and g) finishing the non-woven fabric with water, alkaline or acidic aqueous solutions, with non-polluting organic solvents either alone or in an aqueous solution.

2. The method of preparation of microfibrous non-woven fabric of the suede-finish type according to claim 1, wherein the polyvinylalcohol of reduced solubility comprises:

a polyvinylalcohol with saponification index in the range 85 to 100%.

3. The method of preparation of microfibrous non-woven fabric of the suede-finish type according to claim 1 wherein the hot treatment of the felt impregnated with polyvinylalcohol is carried out at temperatures in a range from 150° to 200° C.

4. The method of preparation of microfibrous non-woven fabric of the suede-finish type according to claim 1 wherein the "islands" component of the bi-component fiber is chosen from polyethylenterephthalate, modified polyesters, cationic polyesters, nylon and other types of polyamides, from polyethylene, polypropylene and other polyolefines and combinations thereof.

5. The method of preparation of microfibrous non-woven fabric of the suede-finish type according to claim 1 wherein the "sea" component of the bi-component fiber is chosen from nylon or other polyamides, modified polyesters and, in a generalized manner, from other soluble filamentable polymers in aqueous solvents and non-polluting solvents and combinations thereof.

6. The method of preparation of microfibrous non-woven fabric of the suede-finish type according to claim 1 wherein the extraction of the sea component of the bi-component fiber is carried out by means of a treatment with an aqueous solution of sodium hydroxide, with a concentration in the range 1% to 15% and at a temperature between 40° and 90° C.; for a time that varies from 4 to 40 minutes.

7. The method of preparation of microfibrous non-woven fabric of the suede-finish type according to claim 1 wherein the impregnation with polyurethane is carried out by treating the felt from which "sea" component has been extracted with a polyurethane emulsion or dispersion comprising dimethylformamide or dimethylacetamide.

8. The method of preparation of microfibrous non-woven fabric of the suede-finish type according to claim 7, wherein the polyurethane comprises polyols that are chosen from polyether type, polyester type, polycarbonate type, polyester-polycarbonate type and combinations thereof.

9. The method of preparation of microfibrous non-woven fabric of the suede-finish type according to claim 7 wherein the polyurethane comprises polyols including an average numerical molecular weight between 500 and 5000.

10. The method of preparation of microfibrous non-woven fabric of the suede-finish type according to claim 7 wherein the polyurethane is obtained by preliminarily preparing a prepolymer with terminal isocyanic groups, bringing it to emulsion by means of energetic agitation of the prepolimero-water mixture and extending the prepolymer with a conventional chain extender.

11. The method of preparation of microfibrous non-woven fabric of the suede-finish type according to claim 7 wherein the polyurethane emulsion or dispersion is obtained by using a prepolymer that contains polyols with hydrophylic character or polar constituents.

12. The method of preparation of microfibrous non-woven fabric of the suede-finish type according to claim 1 wherein the impregnation with polyurethane is carried out by treating the felt from which the "sea" component has been extracted with an aqueous polyurethane emulsion or dispersion.

13. The method of preparation of microfibrous non-woven fabric of the suede-finish type according to claim 12 wherein the impregnation with polyurethane emulsion or dispersion is followed by a treatment of the felt at high temperature or with cross-linking agents in order to increase the resistance of the impregnated polyurethane to the action of solvents.

14. The method of preparation of microfibrous non-woven fabric of the suede-finish type according to claim 13 wherein the treatment of the felt with cross-linking agents in order to increase the resistance of the impregnated polyurethane to the action of solvents is carried out at temperatures in the range 110° to 180° C., the cross-linking agents being chosen from aziridine, melamines, carbodiimides, epoxides, composed of zirconium, isocyan bases and combinations thereof.

15. The method of preparation of microfibrous non-woven fabric of the suede-finish type according to claim 12, wherein the polyurethane comprises polyols that are chosen from polyether type, polyester type, polycarbonate type, polyester-polycarbonate type and combinations thereof.

16. The method of preparation of microfibrous non-woven fabric of the suede-finish type according to claim 12 wherein the polyurethane comprises polyols including an average numerical molecular weight between 500 and 5000.

17. The method of preparation of microfibrous non-woven fabric of the suede-finish type according to claim 12 wherein the polyurethane is obtained by preliminarily preparing a prepolymer with terminal isocyanic groups, bringing it to aqueous emulsion by means of energetic agitation of the prepolimero-water mixture and extending the prepolymer with a conventional chain extender.

18. The method of preparation of microfibrous non-woven fabric of the suede-finish type according to claim 12 wherein the polyurethane emulsion or dispersion is obtained by using a prepolymer that contains polyols with hydrophylic character or polar constituents.

19. The method of preparation of microfibrous non-woven fabric of the suede-finish type according to claim 1 wherein in addition to successive hot impregnation treatments the solubility of the polyvinylalcohol is reduced by addition to the aqueous polyvinylalcohol impregnation solution of compounds that can cause polymer cross-linking.

20. The method of preparation of microfibrous non-woven fabric of the suede-finish type according to claim 19, wherein the cross-linking compounds that cause reticulation of the polyvinylalcohol are chosen from boric acids.

21. A method for the preparation of microfibrous non-woven fabric of the suede-finish type comprising the following steps:

a) spinning of a bi-component fiber of the "islands in the sea" type in which the "island" comprises a polymer chosen from among those employed in textile applications while the "sea" is a polymer that can be dissolved and removed;

b) preparing a felt with the bi-component fiber;

c) impregnating the felt with aqueous solution of polyvinylalcohol with reduced or reducible solubility in water, wherein the reduction of polyvinylalcohol solubility is obtained by submitting the impregnated felt both to hot treatment and cross-linking agent;

d) removing the "sea" component by treatment with water, alkaline or acidic aqueous solutions, with non-polluting organic solvents either alone or in an aqueous solution;

e) impregnating with polyurethane emulsion or dispersion;

f) removing the polyvinylalcohol; and g) finishing the non-woven fabric with water, alkaline or acidic aqueous solutions, with non-polluting organic solvents either alone or in an aqueous solution.

22. The method of preparation of microfibrous non-woven fabric of the suede-finish type according to claim 21 wherein the polyvinylalcohol of reduced solubility comprises a polyvinylalcohol with saponification index greater than 99.5%.

* * * * *